United States Patent [19]

Opie

[11] Patent Number: 4,877,348

[45] Date of Patent: Oct. 31, 1989

[54] MANUALLY OPERATED PAINT STRIPER

[76] Inventor: David H. Opie, 614 Grandview Road, Fort Erie, Ontario, Canada, L2A 4V3

[21] Appl. No.: 244,483

[22] Filed: Sep. 14, 1988

[51] Int. Cl.[4] ..... E01C 23/16

[52] U.S. Cl. ..... 404/93; 404/94; 239/150; 118/300

[58] Field of Search ..... 404/93, 94, 101, 108, 404/111; 239/146, 150, 151, 158, 159; 118/300, 305

[56] References Cited

U.S. PATENT DOCUMENTS

| | | | |
|---|---|---|---|
| 1,998,502 | 4/1935 | Glasgow | 239/150 X |
| 1,999,563 | 4/1935 | Glasgow | 239/150 X |
| 2,964,245 | 12/1960 | Anderson et al. | 239/150 |
| 3,239,147 | 3/1966 | Sweet | 239/150 |
| 3,279,336 | 10/1966 | Eaton et al. | 404/94 |
| 3,687,371 | 8/1972 | Swager | 118/305 X |
| 3,940,065 | 2/1976 | Ware et al. | 239/146 |
| 4,624,602 | 11/1986 | Kieffer et al. | 404/94 |
| 4,708,088 | 11/1987 | Purvis et al. | 118/300 |

FOREIGN PATENT DOCUMENTS

| | | | |
|---|---|---|---|
| 3040680 | 6/1982 | Fed. Rep. of Germany | 404/93 |
| 2597521 | 10/1987 | France | 404/93 |

*Primary Examiner*—Stephen J. Novosad
*Assistant Examiner*—G. Spahn
*Attorney, Agent, or Firm*—Joseph P. Gastel

[57] ABSTRACT

A manually operated paint striper including an elongated frame mounted on wheels, an elongated container of compressed nitrogen mounted on the frame, an elongated container for striping paint mounted on the frame in an upwardly inclined attitude, conduits effecting communication between the nitrogen container and the paint container for providing a zone of compressed nitrogen in the upper portion of the paint container, a spray gun mounted on the lower portion of the frame, a conduit for effecting communication between the lower portion of the paint container and the spray gun, mounting structure for permitting removal of the spray gun from the frame to effect spraying in an area remote from the striper, and suitable controls for selectively actuating the spray gun from a remote position on the frame.

14 Claims, 3 Drawing Sheets

Fig. 1.
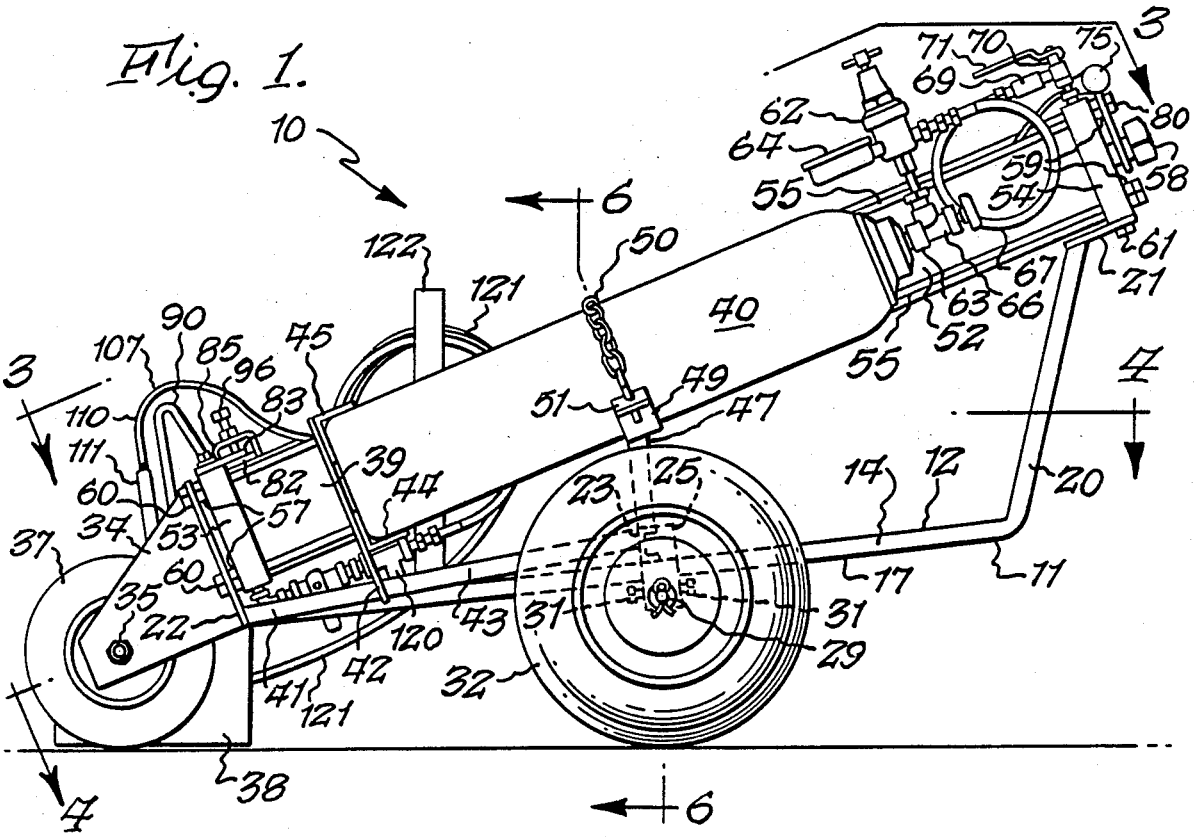
Fig. 10.
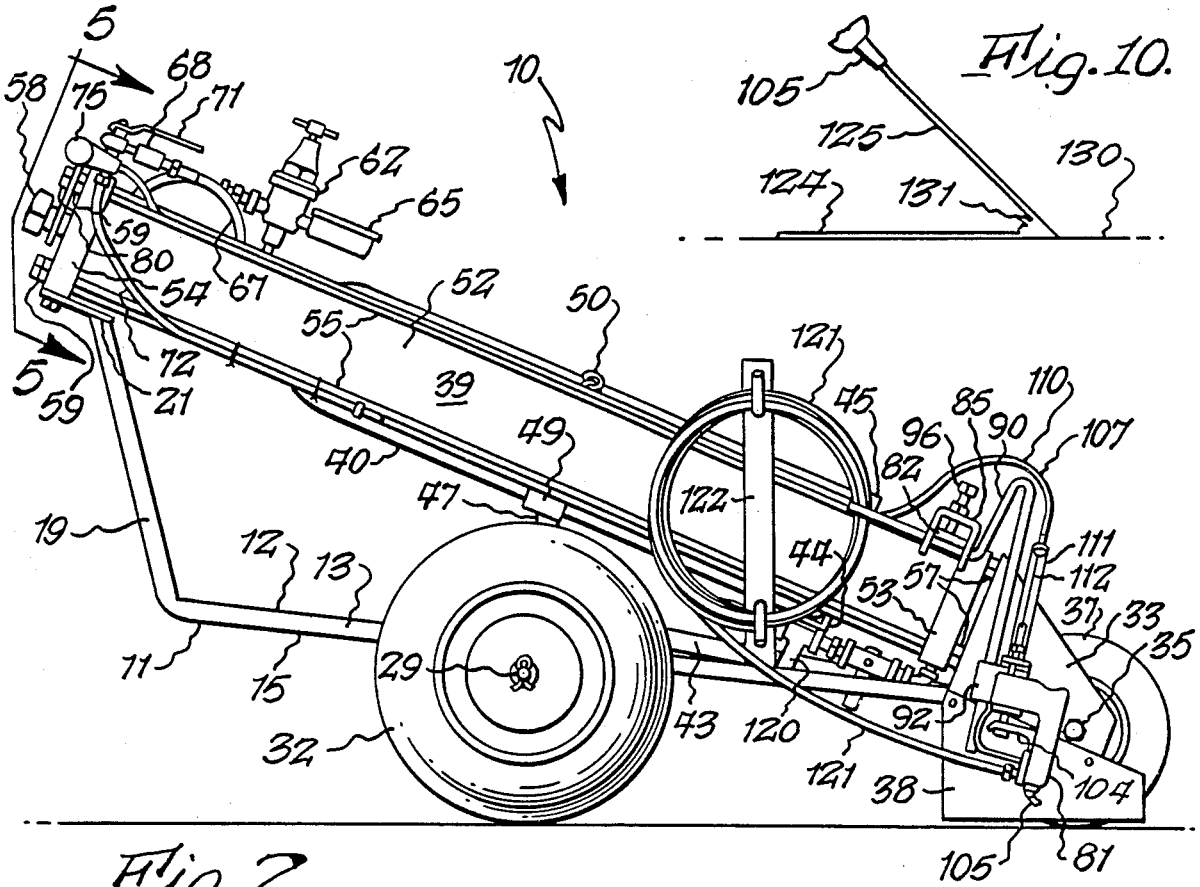
Fig. 2.

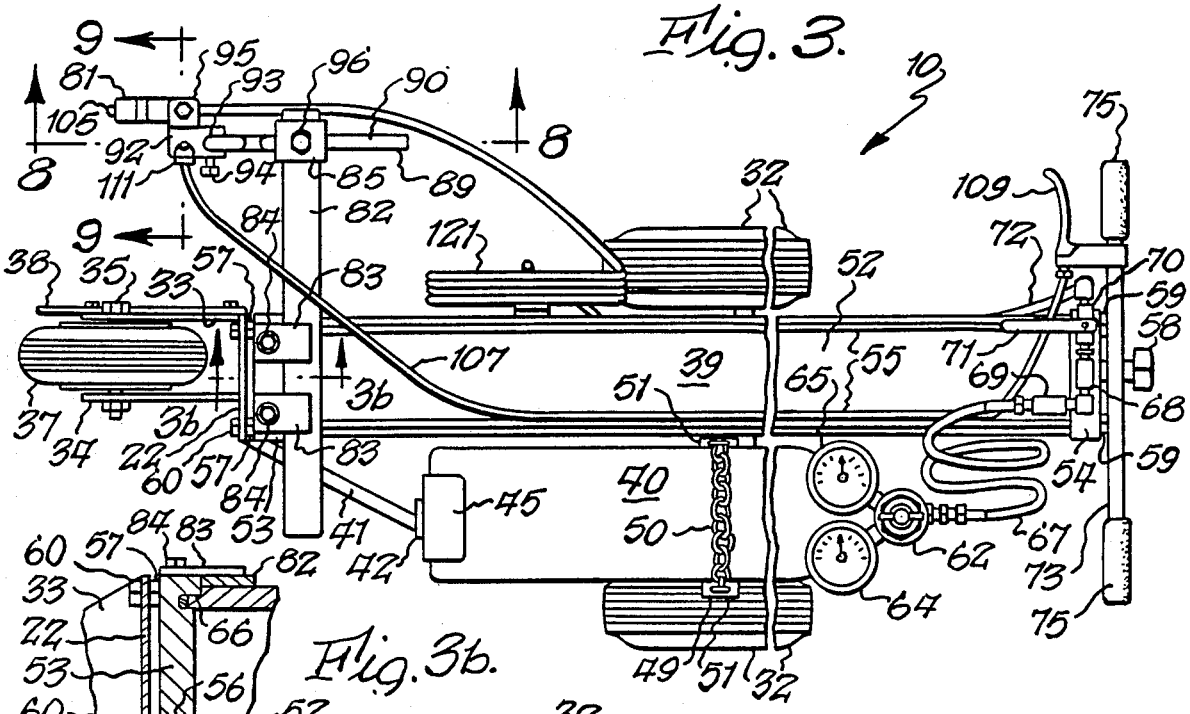
Fig. 3.
10
9
8
95
93
96
90
81
105
92
111
94
85
89
84
82
121
32
109
75
72
70
59
58
38
35
33
57
83
52
107
39
51
65
55
71
69
68
37
34
22
60
3b
53
41
42
45
40
50
54
67
62
64
73
49
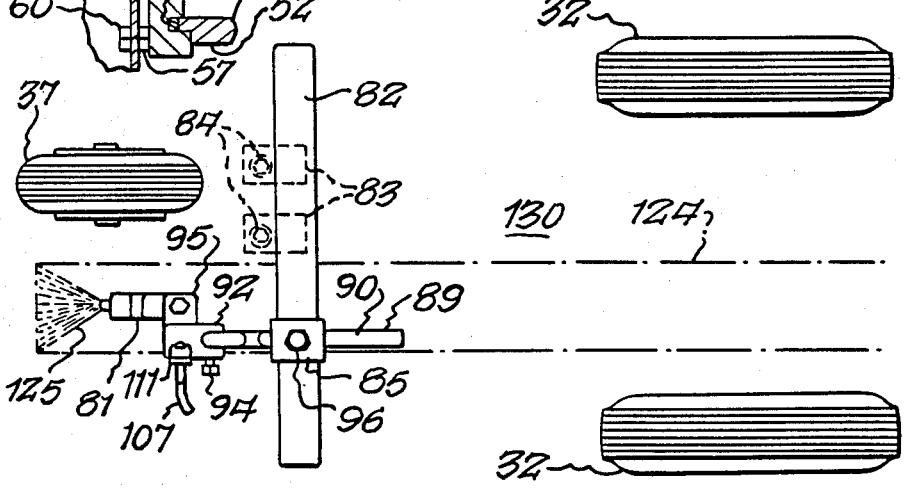
Fig. 3b.
66
56
52
57
32
37
82
84
83
130
124
95
92
90
89
125
81
111
94
107
85
96
Fig. 3a.
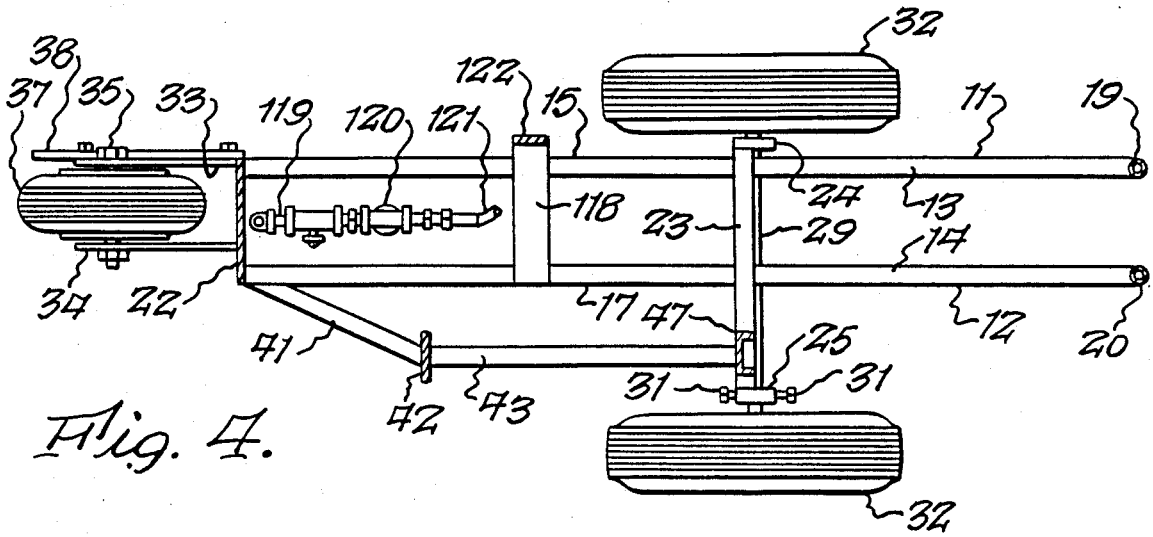
38
37
35
33
119
120
121
122
15
32
11
19
118
23
24
29
13
14
34
22
17
47
12
20
41
42
43
25
31
Fig. 4.

Fig. 5.
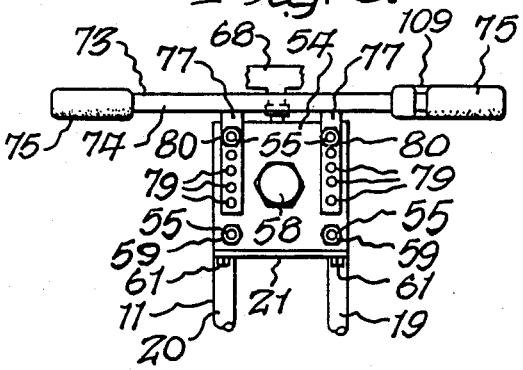
Fig. 6.
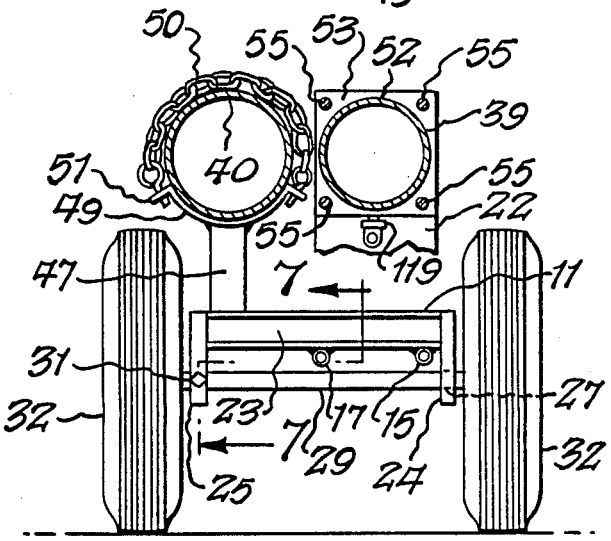
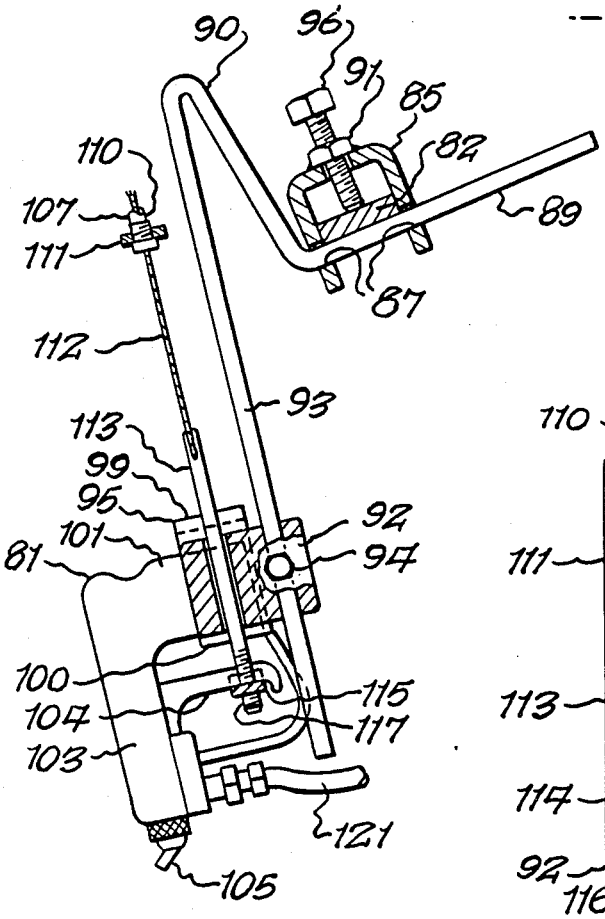
Fig. 8.
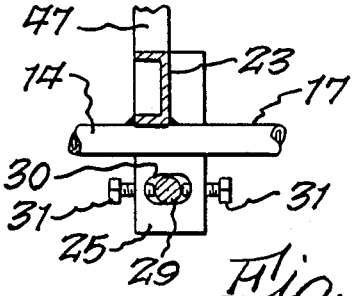
Fig. 7.
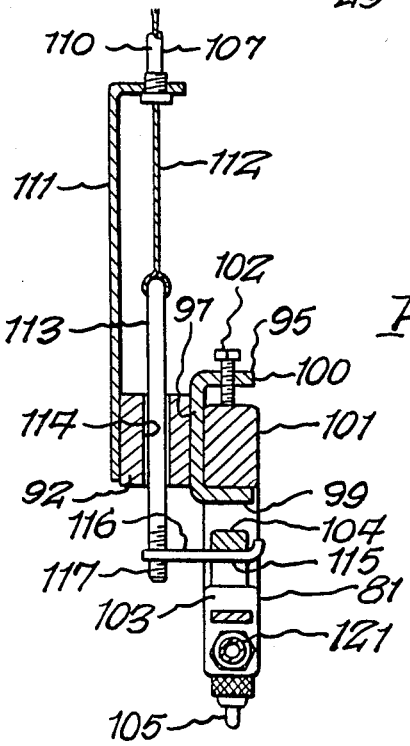
Fig. 9.

MANUALLY OPERATED PAINT STRIPER

BACKGROUND OF THE INVENTION

The present invention relates to an improved paint striper of the type utilized to paint stripes on pavements, parking lots and the like.

By way of background, paint stripers are in common usage for laying down painted stripes on highways, crosswalks, factory floors, and the like. There are generally two types of paint stripers which are used. One type applies high pressure in the range of 2500 psi to paint to provide an atomized spray of paint by forcing the paint through a very small nozzle to project it on the surface which is being striped. However, sprayers of this type have the drawback that the atomized paint provides an "over-spray" which causes paint to be deposited laterally outwardly of the desired area. There is also another general type of paint striper which forces paint from a nozzle by applying pressure to the paint within a container, this pressure usually being applied by means of a piston which applies pressure to the paint between about 15 and 30 psi. However, it has been found that the spray which is being projected onto the surface has a "bounce-back" which causes the paint to rebound from the surface and splatter laterally outwardly beyond the designated spray area. There is also another type of striper in existence which uses a piston air compressor, which in turn provides air pressure in the range of 5 to 100 psi to a sealed tank filled with paint. The air pressure within this tank forces the paint under pressure to a spray nozzle. Simultaneously, air pressure from the piston air compressor is introduced into the paint exiting the spray nozzle or before the paint leaves the nozzle. The purpose of this air introduction is to atomize the paint to reduce bounce-back and overspray. However, this type of machine tends to be quite complicated, noisy, and requires constant maintenance.

By way of further background, there are instances where a small manually operable paint striper is required, as in painting stripes on parking lots, crosswalks, floors of factories, and the like. It is with an improved manually operable paint striper of the foregoing type and which does not have the above drawbacks that the present invention is concerned.

SUMMARY OF THE INVENTION

It is accordingly one object of the present invention to provide an improved manually operable paint striper wherein compressed gas is used to force paint from a lower portion of a paint container at a relatively high pressure and through an associated spray nozzle without causing an overspray or bounce-back.

Another object of the present invention is to provide an improved paint striper in which compressed gas is applied directly to the upper portion of paint in a vertically oriented container to force paint therefrom.

A further object of the present invention is to provide an improved manually operable paint striper which utilizes compressed nitrogen as a propellant for striping paint, thereby obviating the possibility of quick-drying paint congealing in the paint container due to oxidation.

A further object of the present invention is to provide an improved manually operable paint sprayer wherein a conventional spray gun is mounted on a carriage in a unique manner to provide a stripe spraying function, and which can be removed from the carriage to effect manual spraying.

Yet another object of the present invention is to provide an improved manually operable paint sprayer in which a spray gun can be mounted in a plurality of positions as required for different jobs, including mounting it within the span of the widest spread of its wheels to thereby permit the paint striper to be used in extremely narrow spaces.

A still further object of the present invention is to provide an improved paint striper wherein an elongated paint container and an elongated container of pressurized gas are supported longitudinally of a carriage to cause the sprayer to be relatively narrow in configuration.

A still further object of the present invention is to provide an improved paint striper having a welded frame and an adjustable axle for supporting certain wheels to thereby permit it to be aligned exactly perpendicular to the longitudinal axis of the frame.

Yet another object of the present invention is to provide a paint striper which is extremely silent in operation to thereby permit the operator to hear oncoming traffic.

A still further object of the present invention is to provide a manually operated paint striper which contains parts which are uniquely integrated with each other in an extremely simple and unique manner. Other objects and attendant advantages of the present invention will readily be perceived hereafter.

The present invention relates to a striper comprising a frame having an upper portion and a lower portion, a plurality of wheels mounted on said frame, a self-contained paint container, first means for mounting said paint container on said frame, a self-contained compressed gas container, second means for mounting said compressed gas container on said frame, conduit means including pressure reducing means coupling said compressed gas container to said paint container, paint spray means for spraying paint, means coupling said paint spray means to said paint container, means mounting said paint spray means proximate said lower portion of said frame, and means for actuating said paint spray means.

The present invention also relates to spray apparatus for spraying paint comprising a paint container, paint spray means, first means for effecting communication between said paint container and said paint spray means, a source of compressed nitrogen, and second means for effecting communication between said paint container and said source of compressed nitrogen to force paint from said paint container to said paint spray means.

The various aspects of the present invention will be more fully understood when the following portions of the specification are read in conjunction with the accompanying drawings wherein:

BRIEF DESCRIPTION OF THE DRAWINGS

FIG. 1 is a side elevational view of the right side of the striper, when viewed from the front;

FIG. 2 is a side elevational view of the left side of the striper, when viewed from the front;

FIG. 3 is a fragmentary plan view of the striper taken substantially in the direction of arrows 3—3 of FIG. 1;

FIG. 3*a* is a schematic view showing the spray gun of the striper mounted within the span of the rear wheels;

FIG. 3*b* is a fragmentary cross sectional view taken substantially along line 3*b*—3*b* of FIG. 3;

FIG. 4 is a cross sectional view taken substantially along line 4—4 of FIG. 1;

FIG. 5 is a fragmentary end elevational view taken substantially in the direction of arrows 5—5 of FIG. 2;

FIG. 6 is a cross sectional view, with certain parts omitted, taken substantially along line 6—6 of FIG. 1;

FIG. 7 is a fragmentary cross sectional view taken substantially along line 7—7 of FIG. 6 and showing the details of the axle adjustment;

FIG. 8 is a fragmentary cross sectional view taken subtantially along line 8—8 of FIG. 3 and showing the mounting structure for the spray gun;

FIG. 9 is a fragmentary cross sectional view taken substantially along line 9—9 of FIG. 3 and showing additional details of the mounting structure for the spray gun; and FIG. 10 is a schematic view of the manner in which the stripe is sprayed without bounce-back.

DESCRIPTION OF THE PREFERRED EMBODIMENTS

The improved striper 10 comprises a carriage which includes a frame 11 consisting of an elongated frame portion 12 formed by a pair of substantially parallel rods 13 and 14 having substantially horizontal lower portions 15 and 17, respectively, which merge at a junction into upwardly inclined portions 19 and 20, respectively, which are secured, by welding to the underside of plate 21. The junction acts as a stop to prevent the frame from tilting rearwardly beyond a predetermined amount. The forward ends of portions 14 and 17 are secured by welding to plate 22. A cross member 23 in the form of a channel (FIGS. 4, 6 and 7) is welded to the tops of frame portions 15 and 17 (FIG. 6). A pair of plates 24 and 25 which are identical in outer dimensions have their facing sides welded to the opposite ends of cross member 23. Plate 24 has a substantially circular bore 27 therein which is only slightly larger than the diameter of cylindrical axle 29 which extends therethrough. The opposite end of axle 29 extends through elongated slot 30 (FIG. 7) in plate 25. A pair of set screws 31 are threadably received in plate 25 to adjust the fore and aft position of the portion of axle 29 which is contained therein, this being permitted by the fact that bore 27 is slightly oversized. Because of this structure, the rear wheels 32, which are suitably journalled on axle 29, can be aligned relative to frame 11 so that the striper 10 will travel in a perfectly straight line. In other words, axle 29 can be aligned to be exactly perpendicular to the longitudinal axis of the frame. This adjustment is necessary because of the fact that precise alignment cannot be obtained from parts which have been welded. A pair of spaced parallel plates 33 and 34 are welded to plate 22 and support axle 35 on which front wheel 37 is journalled, and a spray shield 38 is secured to plate 33 to protect wheel 37 from the paint which is sprayed.

In accordance with the present invention, a self-contained paint container 39 and a self-contained compressed gas container 40 are mounted on frame 11. More specifically, a strut 41 has its forward end welded to plate 22 (FIG. 1) and its rear end welded to plate 42. A second strut 43 has its forward end welded to plate 42 and its rear end welded to cross member 23. Plate 42 has bracket portions 44 and 45 attached thereto which support the lower end of compressed gas container 40. A standard 47 (FIG. 6) has its lower end welded to the top of cross member 23 and an arcuate saddle 49 is welded to its upper end. A chain 50 has suitable locking members on its opposite ends which are fastened to end tabs 51 of saddle 49 to securely hold container 40 in position.

Paint container 39 consists of a central cylindrical portion 52 and end blocks 53 and 54 secured to opposite ends thereof in sealing relationship. In this respect a suitable gasket 56 is secured between the ends of cylinder 52 and blocks 53, with the end of the cylinder being contained within a groove 66 in the block. An identical sealing arrangement is associated with block 54. To hold blocks 53 and 54 in sealed relationship with cylinder 52, four tie rods 55 are utilized. The lower ends of tie rods 55 have nuts 57 threaded thereon. The upper ends of tie rods 55 have nuts 59 threaded thereon. By tightening nuts 57 and 59, blocks 53 and 54 are maintained in sealed relationship with cylinder 52. In addition, the lower ends of tie rods 55 extend through plate 22 (FIGS. 1 and 3) and four nuts 60 secure the tie rods to the plate. The upper block 54 is secured to plate 21 (FIGS. 1 and 5) by screws 61. Thus, paint container 39 has its lower and upper portions fixedly secured to frame 11. A filler cap 58 is mounted on upper block 54, and it seals a conduit (not numbered) which passes through block 54 and through which paint is poured into container 39.

A pressure regulator and reducer 62 is in communication with the outlet 63 of compressed gas container 40, and a pair of gauges 64 and 65 measure the inlet and outlet pressure, respectively, at the pressure reducer and regulator. A manually actuatable valve 66 (FIG. 1) opens and shuts communication between container 40 and conduit 67 which effects communication from pressure reducer 62 to check valve 69 which permits flow from gas container 40 when the pressure therein exceeds the pressure in container 39, but does not permit back flow to container 40. Check valve 69 is in communication with tee 68 (FIGS. 3 and 5) which leads to container 39 and to manual valve 70 having a handle 71. When valve 70 is in an open position, it permits paint container 39 to be vented through tee 68 and hose 72. When valve 70 vents paint container 39, valve 66 must be closed to prevent venting of compressed gas container 40. When valve 70 is in a closed condition, it blocks flow to venting conduit 72.

A handle 73 (FIG. 5) has an upper horizontal portion 74 with hand grips 75 at opposite ends thereof. Strips 77 extend downwardly from horizontal portion 74 and have a plurality of apertures 79 therein. An end of each of the two upper rods 55 extends through a select aperture in each of strips 77 and nuts 80 to secure the latter to upper block 54. It is by this means that the handle 73 can be raised or lowered to the preferred height of the operator who grasps hand grips 75 to push the striper 10 during a striping operation.

A conventional spray gun 81 is mounted proximate the lower front end of the frame. This gun may be Model 30¼ manufactured by Spraying Systems Co. In this respect, a horizontal bar 82 is pressed against the top of cylinder 52 by tabs 83 which are secured to block 53 by screws 84, thereby firmly holding bar 82 in place. An inverted U-shaped bracket 85 has a pair of holes 87 (FIG. 8) in its legs which receive the end portion 89 of cylindrical rod 90. A nut 91 is welded to the top of bracket 85, and when screw 96 is tightened to bear against the top of bar 82, rod 90 will be retained in position by portion 89 which is wedged between the underside of bar 82 and the lower sides of holes 87. Rod 90 can be moved back and forth along bar 82 by adjusting the position of bracket 85. Furthermore, rod portion 89 can be pivoted in apertures 87 and retained in such a pivoted position by the above wedging action if it is desired to spray sideways. A bracket 92 is adjustably mounted on the descending portion 93 of rod 90, and it is retained in position by means of a set screw 94 which extends through bracket 92 and bears against rod portion 93. A U-shaped member 95 (FIG. 9) has its side 97 welded to bracket 92, and it has lower leg 99 and upper leg 100. The handle 101 of the spray gun rests on lower leg 99, and it is secured within bracket 95 by set screw 102.

Spray gun 81 includes a body 103 and a trigger 104 which is spring-biased to an off position by a spring (not shown) within the body. A spray nozzle 105 is suitably mounted on the spray gun, and it may be a type manufactured by the Titan Co. and known as Model No. 049. When the trigger is in an off position, there will be no spray emanating from nozzle 105. However, when trigger 104 is pulled upwardly against the bias of its spring, pressurized fluid will flow from nozzle 105.

In order to actuate trigger 104, a wire cable unit 107 is provided. One end of the cable 112 of cable unit 107 is attached to lever 109 mounted proximate one of the hand grips 75 for manipulation by the operator. One end of the sheath 110 of the wire cable unit is suitably fixed relative to handle 75, and the other end of the sheath 110 of the cable unit is mounted on bracket 111 which extends upwardly from bracket 92. The cable 112 within sheath 110 is secured to the upper end of slide member 113 which is guided for vertical sliding movement within bore 114 in bracket 92. A finger 115 is secured to the lower end of slide member 113, and the upper side 116 of the finger bears against trigger 104. The finger 115 is threadably mounted at the end of member 113 on threads 117 so that its position can be adjusted. Thus, when lever 109 is pivoted, slide member 113 will slide upwardly in FIGS. 8 and 9 to press finger 115 against trigger 104 to actuate spray gun 81. When the spray gun is actuated, paint will be forced from paint container 39 to the spray gun through conduit 119, strainer 120 and conduit 121, which is coiled on bracket 122 and has its end connected to the spray gun at 123. The lower portion 118 of bracket 2 is welded to frame portions 15 and 17 (FIG. 4).

In operation, compressed gas is supplied from container 40 to paint container 39, and when the trigger is pulled on the spray gun 81, a spray will emanate from nozzle 105. When lever 109 is released, the spring within the spray gun itself will shut off flow. Compressed gas container 40 preferably contains nitrogen rather than air for a number of reasons. One reason is that high pressure nitrogen containers are readily available for use at high pressures which are usable and which will provide a relatively long spraying time, whereas compressed air cannot usually be obtained at the pressures which are desired and which will permit operation of the striper for a relatively long period of time. In this respect, the nitrogen container 40 provides nitrogen at a pressure of 2200 psi which is reduced by valve 62 to about 300 psi for use in paint container 39. The pressure of 300 psi causes a flow coating or extrusion of the paint from nozzle 105, and thus there is very little "overspray," that is, a spray in the air which is not deposited on the stripe which is being created, as is the case where the paint is projected by an atomizing air jet, that is, by the flow of air across a nozzle to aspirate paint from the nozzle, as in certain prior devices wherein the pressures are in the range of 2500 psi. Furthermore, in other types of prior devices the paint is extruded through the nozzle by applying pressure to the paint itself at 15–30 psi, but in devices of this type there is a "bounce-back" of the paint from the surface being painted, which causes splattering outside of the stripe. In the present case, the combination of the viscosity of the paint and the application to the surface being painted at a relatively slow rate permits pressure of about 300 psi to be used without "bounce-back," contrary to what would have been expected because it would seem that more "bounce-back" would have been obtained at 300 psi than is obtained under the same conditions at 15–30 psi pressure. Thus, in the present case, a relatively high viscosity paint of the type conventionally used for striping propelled by a pressure of 300 psi does not produce an overspray and when applied at a slow rate of about 2 mph produces a slight puddling which prevents "bounce-back." In FIG. 10 this is schematically demonstrated wherein the spray stream 125 impinges on surface 130 to produce stripe 124 and a slight puddling occurs at 131 which traps the paint against bouncing back from the surface 130. This slight puddling is temporary, and it merges into a flat strip before the paint dries.

More specifically in the foregoing respect, it has been found that a propelling pressure range of between about 225–350 psi can be used without bounce-back. Furthermore, the optimum thickness of deposit for a four-inch wide line is 18–22 mils, which is equivalent to about 88 square feet per gallon of paint. However, the paint can be deposited at a thickness of between about 80 and 96 square feet per gallon. The optimum speed at which the four-inch stripe is laid down at a thickness of between 18–22 mils is about 1.6 feet per second, and it can be laid down at a rate of between about 0.8 and 4.0 feet per second, which would vary the thickness of the stripe accordingly. Paint container 39 holds five gallons of paint, which can provide 1320 feet of four-inch striping, or approximately 440 square feet of coverage. Nitrogen cylinder 40 is rated to provide approximately 80 cubic feet of nitrogen at atmospheric pressure, and it supplies sufficient pressurized nitrogen to dispense 35 gallons of paint.

Additionally, the nitrogen, being devoid of oxygen, will not cause the paint within paint container 39 to congeal. In this respect, it is to be noted that the paint which is to be used is the conventional striping paint which is used for producing dividing lines on highways and in parking lots, and it can be any federal or state approved marking paint. This paint dries thoroughly within six minutes upon exposure to the air, and more particularly on exposure to the oxygen within the air. Thus by using nitrogen, which does not contain oxygen, instead of compressed air, which does contain oxygen, congealing of the paint is avoided which, in turn, leads to trouble-free operation. It is to be especially noted that the pressurized nitrogen is contained in the upper portion of the vertically oriented paint container 39, and thus it applies pressure directly to the top of the paint within the container, thereby obviating a piston structure which would otherwise be used. It is this pressure which forces the paint out of nozzle 105 when trigger 104 is actuated. In other words, the paint is forced out directly. It is not atomized by a jet of gas passing across the outlet nozzle, which might produce an undesirable over-spray or mist which in turn causes the paint to be spread laterally beyond the width of the desired stripe. The nozzle 105 is of the adjustable type to adjust the width of the spray which is laid down. However, the width of the spray can also be adjusted by adjusting bracket 92 vertically on its supporting rod portion 93.

As can be seen from FIG. 3, the spray gun 81 is located outside of wheel 32. This position is preferable for most usages because the operator can view downwardly toward his right to monitor the striping operation, and further, the operator will not be walking on the stripe which is being laid down. However, as can be seen from FIG. 3, when the spray gun is in the position shown, the overall width of the striper is greater than when the spray gun 81 is located as schematically shown in FIG. 3*a* wherein it is mounted on a portion of bar 82 which is located within the span of rear wheels 32. This relocation can be achieved by mounting bracket 85 as shown, and, if necessary, moving member 82 to the position shown in FIG. 3*a* from the position shown in FIG. 3. The repositioning is also possible because of the fact that conduit 121 has the required length, and this positioning is possible because front wheel 37 is off-center relative to rear wheels 32. In FIG. 3*a* the stripe 124 produced by spray 125 is schematically shown. The relocation of the spray gun to the position of FIG. 3*a* is desirable when the striping has to be effected in spaces which are too narrow to accommodate the striper when the spray gun is mounted in the position of FIG. 3.

There are certain instances where it is desirable to utilize the spray gun in an area remote from striper 10. To this end, the spray gun handle 101 can be released from it associated bracket 95, and the spray gun can be moved to a remote location, only as limited by the length of conduit 121. Thus, spray gun 81 can be used for touch-up jobs.

It is to be especially noted that the use of the compressed gas, preferably nitrogen, to dispense the paint permits the striper to be used in complete silence thus permitting the operator to be more aware of the noises produced by oncoming traffic. Furthermore, since an internal combustion engine is not used to provide a compressed gas, there are not fumes or sparks, thus making the striper manifestly suitable for inplant use, especially in explosive environments. In addition, the nitrogen will not support combustion, thereby further making the striper desirable for use in explosive environments.

While preferred embodiments of the present invention have been disclosed, it will be appreciated that it is not limited thereto but may be otherwise embodied within the scope of the following claims.

What is claimed is:

1. A striper for spraying a stripe of paint onto a surface without substantial bounce-back or overspary comprising a container containing high viscosity marking paint of the type conventionally used for striping, a nozzle, means for forcing said paint from said container through said nozzle by extrusion only at a pressure of between about 225 and 350 psi to produce a stripe of paint on a surface without producing substantial overspray, and means for moving said container across said surface to lay down said stripe at a velocity of between about 0.8 and 4.0 feet per second to thereby obviate bounce-back.

2. A striper as set forth in claim 1 wherein said means for forcing said paint from said container comprises a container of compressed nitrogen at high pressure, pressure-reducing means coupled between said container of compressed nitrogen and said paint container, and a space in said paint container above said paint for permitting said pressurized nitrogen to be applied directly to paint in said paint container.

3. A striper as set forth in claim 1 wherein said means for moving said container moves at a velocity to lay down a stripe of a thickness of between about 18 and 22 mils.

4. A striper as set forth in claim 3 wherein said velocity is about 1.6 feet per second.

5. A method of spraying a stripe of paint onto a surface without substantial bounce-back or overspray comprising the steps of providing a relatively high viscosity marking paint of the type conventionally used for striping, providing a nozzle, forcing said marking paint through said nozzle by extrusion only at a pressure of between about 225 psi and 350 psi to produce a stripe on said surface without an overspray, and laying down said stripe at a velocity of about 0.8 and 4.0 feet per second so as to temporarily cause a slight puddling at the area at which said spray impinges on said surface to thereby trap said paint against bounce-back.

6. A method as set forth in claim 5 wherein said stripe is laid down at a thickness of between about 18 and 22 mils at a velocity of about 1.6 feet per second.

7. A method as set forth in claim 5 wherein said paint is forced through said nozzle by applying pressurized nitrogen gas directly to the surface of the paint.

8. A method as set forth in claim 5 wherein said paint is forced through said nozzle by said extrusion at a pressure of about 300 psi.

9. A method as set forth in claim 5 wherein said four-inch stripe of paint is deposited at a rate of between about 80 and 96 square feet per gallon.

10. A method as set forth in claim 5 wherein said four-inch strip of paint is deposited at a rate of about 88 square feet per gallon.

11. A striper comprising a frame having an upper portion and a lower portion and a front and a rear, a plurality of wheels mounted on said frame, a self-contained paint container, first means for mounting said paint container on said frame, a self-contained compressed nitrogen container, second means for mounting said compressed nitrogen container on said frame, conduit means including pressure reducing means coupling said compressed nitrogen container to said paint container, paint spray means for spraying paint, means coupling said paint spray means to said paint container to receive paint therefrom, means mounting said paint spray means proximate said lower portion of said frame, means proximate said upper portion of said frame for actuating said paint spray means, said paint container having an upper portion and a lower portion, said conduit means coupling said compressed nitrogen container only to said upper portion of said paint container, said compressed nitrogen being contained in said upper portion of said paint container to act directly on the paint therein, an axle, means securing said axle on said lower portion of said frame, said plurality of wheels including a front wheel mounted on said frame proximate said front thereof and two rear wheels mounted on said axle, said frame including a longitudinal axis, means for adjusting said axle mounting said two rear wheels in a transverse direction relative to said longitudinal axis to thereby vary the angle which it makes therewith, said means for adjusting said axle comprising first axle securing means for securing one end of said axle in a relatively fixed position, and second axle securing means for moving the other end of said axle fore and aft and retaining said other end in an adjusted position, said paint spray means comprising a spray gun, said means mounting said paint spray means permitting selective mounting and demounting of said spray gun from said frame, said spray gun including a trigger which is spring-biased to an off position, finger means forming part of said means for actuating said paint spray means for selectively pressing on said trigger in response to the actuation of said means for actuating said paint spray means, said means mounting said paint spray means proximate said lower portion of said frame including means for mounting said paint spray means for transverse adjustment on said frame including an elongated bar extending transversely of said frame, an elongated rod extending downwardly from said elongated bar, first clamp means movably securing said elongated rod to said elongated bar, a handle on said spray gun, sand second clamp means securing said handle of said spray gun to said elongated rod.

12. A striper as set forth in claim 11 wherein said second clamp means is adjustable vertically on said elongated rod to thereby adjust the vertical position of said spray gun.

13. A striper as set forth in claim 11 wherein said first clamp means permits said elongated rod to be swung sideways relative to said elongated bar to thereby permit it to spray in a lateral direction in addition to spraying in a vertical direction.

14. A striper as set forth in claim 11 including clamp means for adjusting said elongated bar laterally of said frame.

* * * * *